US010041303B2

(12) United States Patent
Winslow et al.

(10) Patent No.: US 10,041,303 B2
(45) Date of Patent: Aug. 7, 2018

(54) DRILLING SHAFT DEFLECTION DEVICE

(71) Applicant: HALLIBURTON ENERGY SERVICES, INC., Houston, TX (US)

(72) Inventors: Daniel Martin Winslow, Spring, TX (US); Gopal M. Bhosle, Wetaskiwin (CA)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 144 days.

(21) Appl. No.: 15/111,611

(22) PCT Filed: Feb. 14, 2014

(86) PCT No.: PCT/US2014/016579
§ 371 (c)(1),
(2) Date: Jul. 14, 2016

(87) PCT Pub. No.: WO2015/122918
PCT Pub. Date: Aug. 20, 2015

(65) Prior Publication Data
US 2016/0326803 A1 Nov. 10, 2016

(51) Int. Cl.
*E21B 7/06* (2006.01)
*E21B 17/10* (2006.01)
(Continued)

(52) U.S. Cl.
CPC ..... *E21B 7/067* (2013.01); *E21B 3/00* (2013.01); *E21B 7/062* (2013.01); *E21B 10/42* (2013.01);
(Continued)

(58) Field of Classification Search
CPC ... E21B 4/16; E21B 4/006; E21B 7/06; E21B 7/062; E21B 7/067; E21B 17/10
See application file for complete search history.

(56) References Cited

U.S. PATENT DOCUMENTS 3,196,959 A 7/1965 Kammerer
3,437,810 A * 4/1969 Walters ..... E21B 47/082 250/358.1
(Continued)

FOREIGN PATENT DOCUMENTS

GB 2172325 9/1986
GB 2230288 10/1990
(Continued)

OTHER PUBLICATIONS

OnePetro, "Downhole Steering Automation and New Survey Measurement Method Significantly Improves High-Dogleg Rotary-Steerable System Performance", http://www.onepetro.org/mslib/app/Preview.do?paperNumber=SPE-166165-MS &societyCode=SPE, 2013, Society of Petroleum Engineers, pp. 2.
(Continued)

*Primary Examiner* — Shane Bomar
(74) *Attorney, Agent, or Firm* — Polsinelli PC

(57) ABSTRACT

Drilling shaft deflection device (750) for establishing a deflection angle and azimuthal toolface direction of a drill bit (22) in a rotary steerable subterranean drill (20). The drilling shaft deflection device (750) includes a drilling shaft (24) rotatably supported in a housing (46) and a drilling shaft deflection assembly (92) contained within the housing (46) that transitions the drilling shaft (24) between deflected and undeflected configurations. The deflection device (750) further contains a pair of drive motors (760*a*, 760*b*) anchored to the housing (46) and respectively interconnected to eccentric ring actuators (156, 158) for deflecting and rotating the shaft (24).

21 Claims, 10 Drawing Sheets

(51) Int. Cl.
*E21B 3/00* (2006.01)
*E21B 10/42* (2006.01)
*E21B 47/024* (2006.01)

(52) U.S. Cl.
CPC ..... *E21B 17/1014* (2013.01); *E21B 17/1078* (2013.01); *E21B 47/024* (2013.01)

(56) References Cited

U.S. PATENT DOCUMENTS 3,824,437 A 7/1974 Blaschke
3,835,942 A * 9/1974 Leonardi ..... E21B 4/00 175/104
4,299,296 A 11/1981 Geczy
4,324,297 A 4/1982 Denison
4,394,881 A 7/1983 Shirley
4,407,377 A 10/1983 Russell
4,445,578 A 5/1984 Millheim
4,476,943 A 10/1984 Williams
4,491,187 A 1/1985 Russell
4,662,458 A 5/1987 Ho
4,739,841 A 4/1988 Das
4,754,821 A 7/1988 Swietlik
4,821,563 A 4/1989 Maron
4,947,944 A 8/1990 Coltman et al.
4,958,517 A 9/1990 Maron
5,168,941 A 12/1992 Krueger et al.
5,220,963 A 6/1993 Patton
5,265,684 A 11/1993 Rosenhauch
5,293,945 A 3/1994 Rosenhauch et al.
5,368,110 A 11/1994 French
5,386,724 A 2/1995 Das et al.
5,421,421 A 6/1995 Appleton
5,467,834 A 11/1995 Hughes et al.
5,547,031 A 8/1996 Warren et al.
5,608,162 A 3/1997 Ho
5,685,379 A 11/1997 Barr et al.
5,720,355 A 2/1998 Lamine et al.
5,931,239 A 8/1999 Schuh
6,068,394 A 5/2000 Dublin
6,082,457 A 7/2000 Best et al.
6,092,610 A 7/2000 Kosmala et al.
6,158,529 A 12/2000 Dorel
6,227,313 B1 5/2001 Davis et al.
6,233,524 B1 5/2001 Harrell et al.
6,234,259 B1 * 5/2001 Kuckes ..... E21B 7/062 175/61
6,244,361 B1 6/2001 Comeau et al.
6,321,857 B1 11/2001 Eddison
6,328,119 B1 12/2001 Gills et al.
6,415,878 B1 6/2002 Cargill et al.
6,550,548 B2 4/2003 Taylor
6,769,499 B2 8/2004 Cargill et al.
6,840,336 B2 1/2005 Schaag et al.
7,036,580 B2 5/2006 McGarian et al.
7,147,066 B2 12/2006 Chen et al.
7,216,726 B2 5/2007 Swietlik et al.
7,306,058 B2 12/2007 Cargill et al.
7,306,060 B2 12/2007 Krueger et al.
7,413,032 B2 8/2008 Krueger
7,413,034 B2 8/2008 Kirkhope et al.
7,426,967 B2 9/2008 Sugiura
7,445,060 B2 11/2008 Stroud et al.
7,464,770 B2 12/2008 Jones et al.
7,467,673 B2 12/2008 Earles et al.
7,481,282 B2 1/2009 Horst et al.
7,588,082 B2 9/2009 Lasater
7,637,321 B2 12/2009 Zazovsky et al.
7,685,732 B2 3/2010 Davis et al.
7,703,550 B2 4/2010 Nevlud et al.
7,735,581 B2 6/2010 Beylotte et al.
7,762,356 B2 7/2010 Turner et al.
7,775,099 B2 8/2010 Bogath et al.
7,798,253 B2 9/2010 Schuh
7,950,473 B2 5/2011 Sugiura
7,967,081 B2 6/2011 Sugiura
8,118,114 B2 2/2012 Sugiura
8,191,651 B2 6/2012 Hall et al.
8,191,652 B2 6/2012 Kotsonis et al.
8,286,733 B2 10/2012 Tulloch et al.
8,302,703 B2 11/2012 Rolovic
8,360,172 B2 1/2013 Santelmann
8,453,765 B2 6/2013 Haughom
8,484,858 B2 7/2013 Brannigan et al.
8,534,380 B2 9/2013 Sheppard et al.
2001/0052427 A1 * 12/2001 Eppink ..... E21B 4/006 175/40
2002/0195278 A1 12/2002 Vandenberg et al.
2003/0034178 A1 2/2003 Cargill et al.
2006/0243487 A1 * 11/2006 Turner ..... E21B 7/062 175/26
2008/0190665 A1 * 8/2008 Earles ..... E21B 7/06 175/24
2010/0236830 A1 * 9/2010 Haughom ..... E21B 7/062 175/76
2011/0240368 A1 10/2011 Allen et al.
2012/0046865 A1 2/2012 Heisig et al.
2012/0055327 A1 3/2012 Holowczak
2012/0061099 A1 3/2012 Wold et al.
2012/0132470 A1 5/2012 Jarvis et al.
2012/0285746 A1 11/2012 Kvalvik
2013/0146363 A1 6/2013 Haughom
2013/0319764 A1 * 12/2013 Schaaf ..... E21B 7/06 175/24

FOREIGN PATENT DOCUMENTS

GB 2425791 11/2006
WO 9008245 7/1990
WO 12162833 12/2012

OTHER PUBLICATIONS

Kapoh, Oddy, New Locking Clutch Turbine Technology Successfully Frees Stuck Bit/BHA in Deep Gas Wells Oman, 2011.
Warren, Tommy; Slimhole rotary steerable system broadens applications; Sep. 1997.
Weatherford; Revolutionizing drilling efficiency in all types of environments, 2009.
Rotary Steerable System; (http://www.bakerhughes.com/products-and-services/drilling/drill-bit-systems) published on Jan. 11, 2010, pp. 4.
Oil and Gas Journal , "Rotary Steerable System Replaces Slide Mode for Directional Drilling Applications", http://www.pgj.com/articles/print/volume-96/issue-9/in-this-issue/general-interest/rotary-steerable-system-replaces-slide-mode-f.html ; published on Mar. 2, 1998, pp. 3.
Clegg, Barr.; Steerable Rotary Drilling with an Experimental System, https://www.onepetro.org/, 1995, pp. 2.
OnePetro, "Coupling of Downhole Dynamics Recorder Enhance System-Matched Approach to Drill Bit Design and Application with a Specific Rotary Steerable System." http://www.onepetro.org/mslib/servlet/onepetropreview?id=SPE-102182-MS; 2006, pp. 2.
OnePetro, "The First OffShore Use of an Ultra High Speed Drilling Telemetry Network Involving a Full LWD Logging Suite and Rotary Steerable Drilling System", http://www.onepetro.org/mslib/servlet/onepetropreview?id=SPE-110939-MS Nov. 7, 2007, pp. 2.
OnePetro, "Integrated Approach to Rotary-Steerable Drilling Optimization using Concurrent Real-Time measurement of Near-bit Borehole Caliper and Near-bit Vibration.", http://www.onepetro.org/mslib/servlet/onepetropreview?id=SPE-112163-MS, 2008, pp. 2.
Schlumberger; PowerDrive vorteX Powered Rotary Steerable System; http://www.slb.com/services/drilling/directional_drilling/powerdrive_family/powerdrive_vortex.aspx; 2013 Schlumberger Limited and retrieved Nov. 7, 2013, pp. 2.
OnePetro; "Real-Time BHA Bending Information Reduces Risk when Drilling Hard Interbedded BHA Bending Information Reduces Risk when Drilling Hard Interbedded Formations." http://

(56) References Cited

OTHER PUBLICATIONS www.onepetro.org/mslib/app/Preview.do?paperNumber=00079918 &societyCode=SPE, 2003, pp. 2.
OnePetro, "The Use of the Industry's First 3-D Mechanical Caliper Image While Drilling Leads to Optimized Rotary-Steerable Assemblies in Push- and Point-the-Bit Configurations", http://www.onepetro.org/mslib/app/Preview.do?paperNumber=SPE-115395-MS&societyCode=SPE, 2008. Society of Petroleum Engineers, pp. 2.
International Search Report and Written Opinion; PCT Application No. PCT/US2014/016579; dated Nov. 20, 2014.
International Preliminary Report on Patentability; PCT Application No. PCT/US2014/016579; dated May 16, 2016.

* cited by examiner

DRILLING SHAFT DEFLECTION DEVICE

CROSS-REFERENCE TO RELATED APPLICATIONS

This application is a national stage entry of PCT/US2014/016579 filed Feb. 14, 2014, said application is expressly incorporated herein in its entirety.

FIELD

The present disclosure relates generally to rotary steerable drilling in oil and gas exploration and production operations. More specifically, the present disclosure relates to a biasing device for deflecting the drive shaft in a rotary steerable drilling device.

BACKGROUND

Oil exploration and production requires accessing subterranean formations deep below the surface of the earth, up to several miles. Due to the complexity of the underground environment, drilling requires far more than vertically drilling beneath the surface. Instead, the drilling direction must be controlled to avoid rock beds, correct for directional errors and housing roll, and to reach or maintain a position within a target subterranean destination or formation with a drilling string. Accordingly, directional drilling involves controlling the direction of drilling in a horizontal, as well as vertical direction, and a combination of both.

One type of directional drilling involves rotary steerable drilling systems. Rotary steerable drilling allows a drill string to rotate continuously while steering the drill string to a desired target location in a subterranean formation. Rotary steerable drilling systems are generally positioned at a lower end of the drill string and typically include a rotating drill shaft or mandrel, a housing that anchors in the borehole and rotatably supports the drill shaft, and additional components within the housing that adjust the direction of extension of the drill bit at the end of the drill shaft relative the anchored housing.

BRIEF DESCRIPTION OF THE DRAWINGS

Implementations of the present technology will now be described, by way of example only, with reference to the attached figures, wherein.

DETAILED DESCRIPTION

Figure 1:
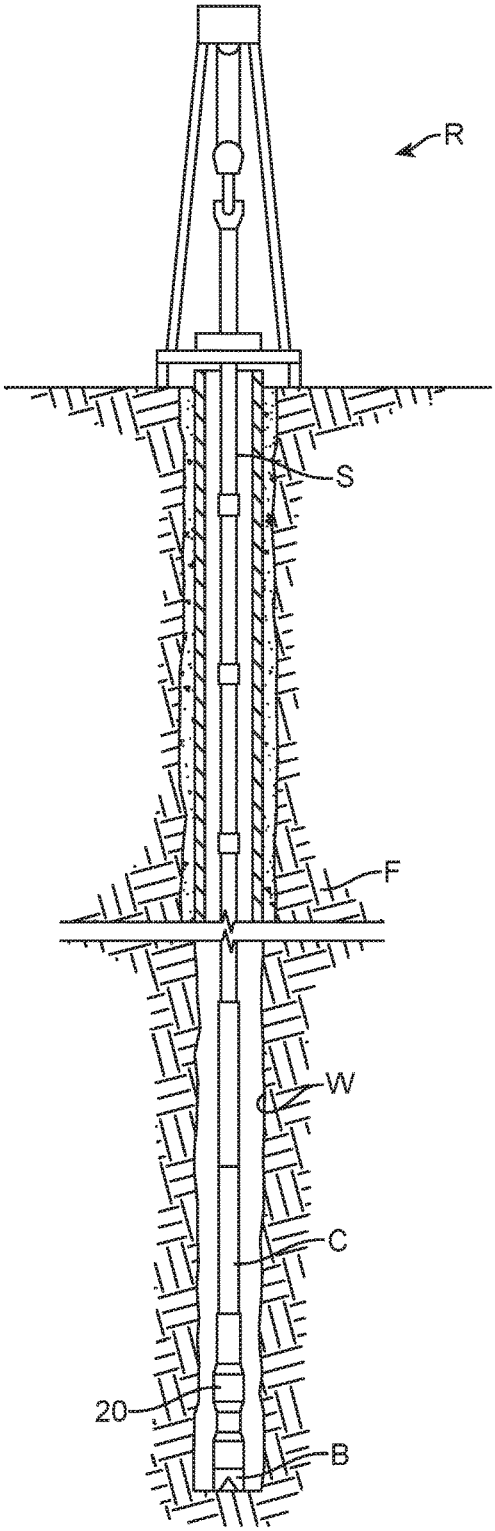
FIG. 1 is a partial cross-section view illustrating an embodiment of a drilling rig for drilling a wellbore with the drilling system in accordance with the principles of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicate that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

A drilling shaft deflection device is disclosed for establishing a deflection angle and azimuthal toolface direction of a drill bit in a rotary steerable subterranean drill. The drilling shaft deflection device can include a drilling shaft having a longitudinal centerline and is rotatably supported in a housing. In at least one example, the housing can be a drilling shaft housing. The housing is generally cylindrical and has a longitudinal centerline. The longitudinal centerlines of the drilling shaft and housing are substantially coincident when the drilling shaft is undeflected within the housing. A drilling shaft deflection assembly is contained within the housing and transitions the drilling shaft between deflected and undeflected configurations.

The deflection assembly is made up of an outer eccentric ring that is rotatably supported at an inner peripheral surface of the housing. The outer eccentric ring has a circular inner peripheral surface that is eccentric with respect to the housing. Additionally, an inner eccentric ring is rotatably supported on the circular inner peripheral surface of the outer eccentric ring. The inner eccentric ring has a circular inner peripheral surface that engages the drilling shaft and which is eccentric with respect to the circular inner peripheral surface of the outer eccentric ring.

The deflection device further includes a pair of drive motors anchored to the housing and respectively interconnected, one each, to the inner and outer eccentric rings. In at least one example, at least one of the pair of drive motors can be bi-directional. In another example, each of the pair of drive motors is bi-directional. One of the pair of motors is drivingly coupled by a first transmission to the outer eccentric ring and which rotates the outer eccentric ring relative to the housing. The rotation of the outer eccentric ring relative to the housing can be in a first direction and an opposite, second direction. The other of the pair of motors is drivingly coupled by a second transmission to the inner eccentric ring and which rotates the inner eccentric ring in a first direction and an opposite, second direction relative to the outer eccentric ring.

Drill String and Rotary Steering Device

FIG. 1 of the drawings illustrates a drill string, indicated generally by the reference letter S, extending from a conventional rotary drilling rig R and in the process of drilling a well bore W into an earth formation F. The lower end portion of the drill string S includes a drill collar C, and a drill tool or bit B at the end of the string S, and a rotary steerable drilling device (20) discussed further below. The drill bit B may be in the form of a roller cone bit or fixed cutter bit or any other type of bit known in the art. In certain configurations, the well bore W is drilled by rotating the drill string S, and therefore the drill bit B, from the rig R in a conventional manner. Those skilled in the art will appreciate that these components are recited as illustrative for contextual purposes and are not intended to limit the disclosure.

Also shown in FIG. 1 is an embodiment of a rotary steerable drilling device (20). The rotary steerable drilling device (20) can also be referred to as a drilling direction control device or system. As shown therein, the rotary drilling device (20) is positioned on the drill string S with drill bit B. However, one of skill in the art will recognize that the positioning of the rotary steerable drilling device (20) on the drill string S and relative to other components on the drill string S may be modified while remaining within the scope of the present disclosure.

Figure 2A:
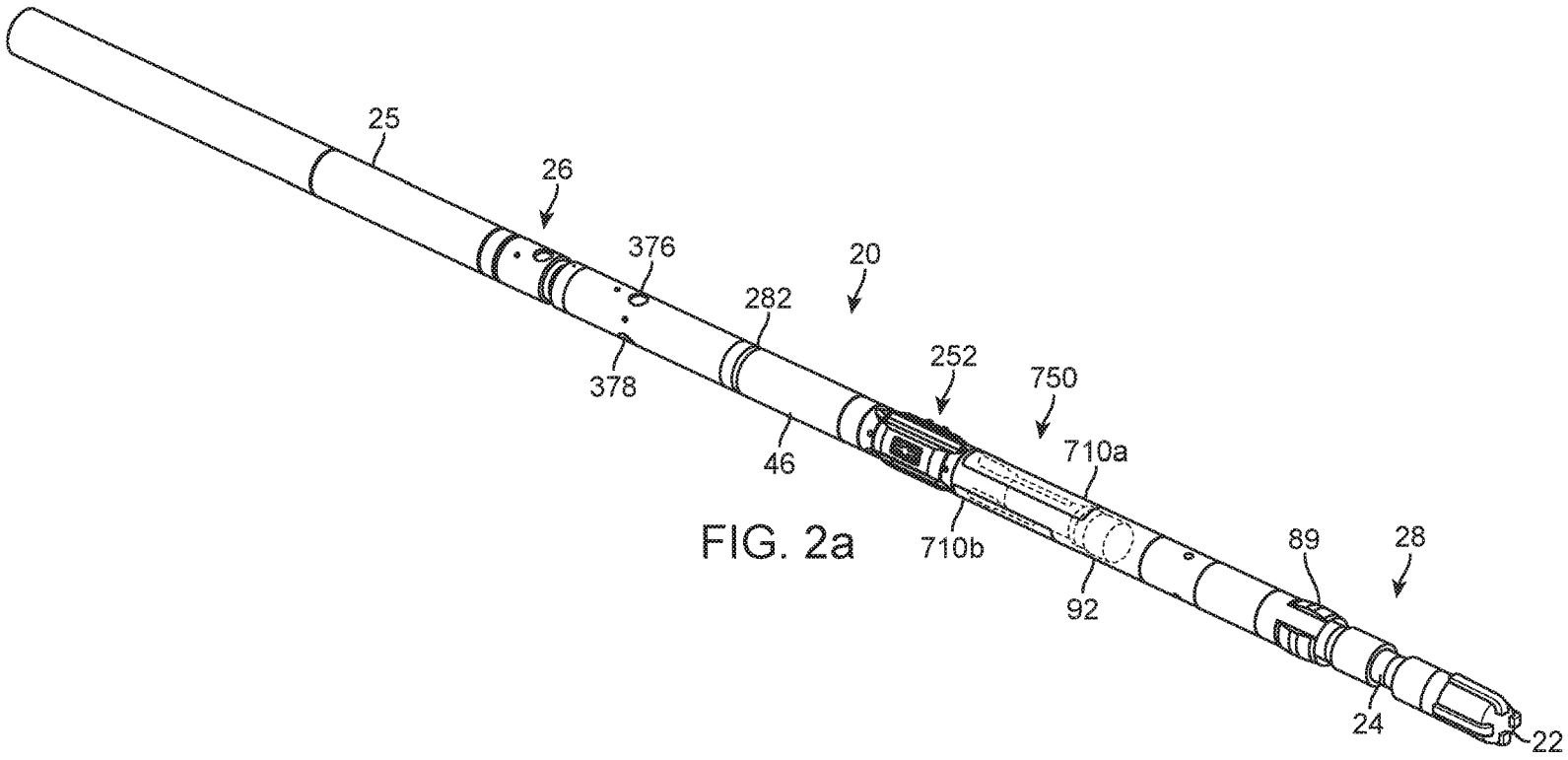
FIG. 2*a* is a perspective view of one embodiment of a rotary steerable drilling device.
Figure 2B:
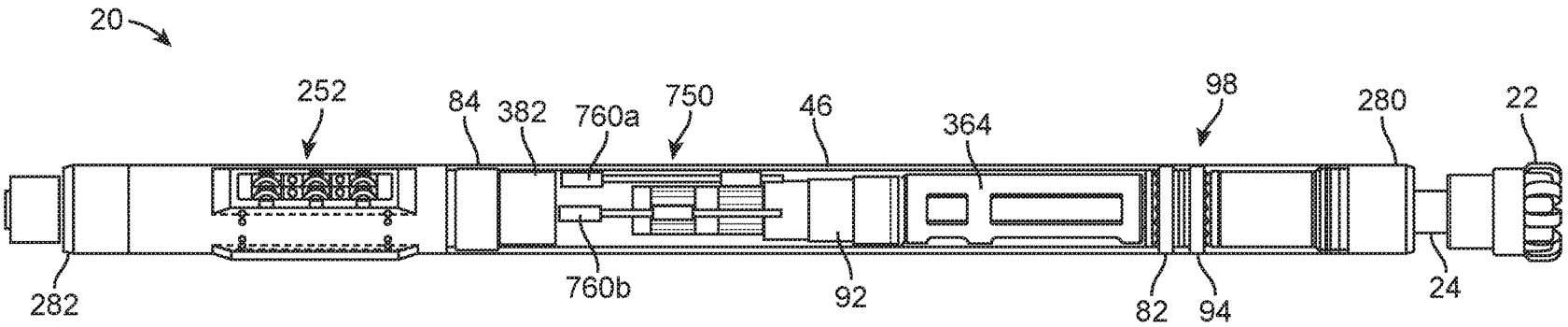
FIG. 2*b* is a side elevational view, partially cut-away, of an embodiment of a rotary steerable drilling device.

Referring now to FIGS. 2*a* and 2*b*, the rotary steerable drilling device (20) is comprised of a rotatable drilling shaft (24) which is connectable or attachable to a rotary drilling bit (22) and to a rotary drilling string (25) during the drilling operation. More particularly, the drilling shaft (24) has a proximal end (26) closest to the earth's surface and a distal end (28) deepest in the well, furthest from the earth's surface. The proximal end (26) is drivingly connectable or attachable with the rotary drilling string (25) such that rotation of the drilling string (25) from the surface results in a corresponding rotation of the drilling shaft (24). The proximal end (26) of the drilling shaft (24) may be permanently or removably attached, connected or otherwise affixed with the drilling string (25) in any manner and by any structure, mechanism, device or method permitting the rotation of the drilling shaft (24) upon the rotation of the drilling string (25). In this regard, a drive connection connects the drilling shaft (24) with the drilling string (25). As indicated, the drive connection may be comprised of any structure, mechanism or device for drivingly connecting the drilling shaft (24) and the drilling string (25) so that rotation of the drilling string (25) results in a corresponding rotation of the drilling shaft (24).

The distal end (28) of the drilling shaft (24) is drivingly connectable or attachable with the rotary drilling bit (22) such that rotation of the drilling shaft (24) by the drilling string (25) results in a corresponding rotation of the drilling bit (22). The distal end (28) of the drilling shaft (24) may be permanently or removably attached, connected or otherwise affixed with the drilling bit (22) in any manner and by any structure, mechanism, device or method permitting the rotation of the drilling bit (22) upon the rotation of the drilling shaft (24). In the exemplary embodiment, a threaded connection is utilized.

The drilling shaft (24) may be comprised of one or more elements or portions connected, attached or otherwise affixed together in any suitable manner providing a unitary drilling shaft (24) between the proximal and distal ends (26, 28). In some examples, any connections provided between the elements or portions of the drilling shaft (24) are relatively rigid such that the drilling shaft (24) does not include any flexible joints or articulations therein. In one embodiment, the drilling shaft (24) is comprised of a single, unitary or integral element extending between the proximal and distal ends (26, 28). Further, the drilling shaft (24) is tubular or hollow to permit drilling fluid to flow therethrough in a relatively unrestricted and unimpeded manner.

The drilling shaft (24) may be comprised of any material suitable for and compatible with rotary drilling. In one embodiment, the drilling shaft (24) is comprised of high strength stainless steel and is sometimes referred to as a mandrel.

The rotary steerable drilling device (20) is comprised of a housing (46) for rotatably supporting a length of the drilling shaft (24) for rotation therein upon rotation of the attached drilling string (25). The housing (46) may support, and extend along any length of the drilling shaft (24). However, in the illustrated example, the housing (46) supports substantially the entire length of the drilling shaft (24) and extends substantially between the proximal and distal ends (26, 28) of the drilling shaft (24).

The housing (46) may be comprised of one or more tubular or hollow elements, sections or components permanently or removably connected, attached or otherwise affixed together to provide a unitary or integral housing (46) permitting the drilling shaft (24) to extend therethrough.

The rotary steerable drilling device (20) may optionally be further comprised of a near bit stabilizer (89), preferably located adjacent to the distal end of the housing (46). The near bit stabilizer (89) may be comprised of any type of stabilizer and may be either adjustable or non-adjustable.

The distal end comprises a distal radial bearing (82) which comprises a fulcrum bearing, also referred to as a focal bearing, or some other bearing which facilitates the pivoting of the drilling shaft (24) at the distal radial bearing location upon the controlled deflection of the drilling shaft (24) by the rotary steerable drilling device (20) to produce a bending or curvature of the drilling shaft (24).

The rotary steerable drilling device (20) is further comprised of at least one proximal radial bearing (84) which is contained within the housing (46) for rotatably supporting the drilling shaft (24) radially at a proximal radial bearing location defined thereby.

The deflection assembly (92) within the rotary steerable drilling device (20) provides for the controlled deflection of the drilling shaft (24) resulting in a bend or curvature of the drilling shaft (24), as described further below, in order to provide the desired deflection of the attached drilling bit (22). The orientation of the deflection of the drilling shaft (24) may be altered in order to change the orientation of the drilling bit (22) or toolface, while the magnitude of the deflection of the drilling shaft (24) may also be altered to vary the magnitude of the deflection of the drilling bit (22) or the bit tilt relative to the housing (46).

The rotary steerable drilling device (20) can comprise a distal seal or sealing assembly (280) and a proximal seal or sealing assembly (282). The distal seal (280) is radially positioned and provides a rotary seal between the housing (46) and the drilling shaft (24) at, adjacent or in proximity to the distal end of the housing (46). In this way, the housing (46) can be maintained as a compartment or container for the contents located therein. In at least one embodiment, the compartment can be a closed compartment when it is sealed.

The rotary steerable drilling device (20) is comprised of at least one distal thrust bearing (94) at thrust bearing location (98). Thrust bearings may be positioned at any location along the length of the drilling shaft (24) that rotatably support the drilling shaft (24) radially within the housing (46), but resist longitudinal movement of the drilling shaft (24) within the housing (46).

The rotary steerable drilling device (20) optionally has a housing orientation sensor apparatus (364) for sensing the orientation of the housing (46) within the wellbore. The housing orientation sensor apparatus (364) can contain an ABI or At-Bit-Inclination insert associated with the housing (46). Additionally, the rotary steerable drilling device (20) can have a drilling string orientation sensor apparatus (376). Sensors which can be employed to determine orientation include for example magnetometers and accelerometers. The rotary steerable drilling device (20) also optionally has a releasable drilling-shaft-to-housing locking assembly (382) which can be used to selectively lock the drilling shaft (24) and housing (46) together. In some situations downhole, it is desired that the shaft (24) not be able rotate relative to the housing (46). One such instance can be if the drilling device (20) gets stuck downhole; in that case it may be desirable to attempt to rotate the housing (46) with the drill string to dislodge the drilling device (2) from the wellbore. In order to do that, the locking assembly (382) is engaged (locked) which prevents the drilling shaft (24) from rotating in the housing (46), and turning the drill string turns the housing (46).

Further, in order that information or data may be communicated along the drilling string (25) from or to downhole locations, the rotary steerable drilling device (20) can include a drilling string communication system (378).

Deflection Mechanism

There are a number of methods for deflecting and bending the drilling shaft (24) in order to orient or direct the drilling bit (22). The rotary steerable drilling device (20) comprises a drilling shaft deflection assembly (92) contained within the housing (46) for bending the drilling shaft (24) therein. The drilling shaft deflection assembly (92) is located axially at a location between the distal radial bearing location (82) and the proximal radial bearing location (84) so that the deflection assembly (92) bends (pulls to the side while rotating) the drilling shaft (24) between the distal radial bearing (82) and the proximal radial bearing (86). Various embodiments of the drilling shaft deflection assembly (92) are described in detail below.

The deflection assembly (92) includes a mechanism for imparting lateral movement to the drilling shaft (24). As shown in the exemplary embodiment illustrated in FIG. 3, the deflection mechanism (384) is comprised of a double ring eccentric mechanism. The eccentric rings may be located at a spaced apart distance from one another along the length of the drilling shaft (24). However, in the illustrated example, the deflection mechanism (384) is comprised of an eccentric outer ring (156) and an eccentric inner ring (158) provided one within the other at the same axial location or position along the drilling shaft (24), within the housing (46). Rotation of one or both of the two eccentric rings (156, 158) imparts a controlled deflection of the drilling shaft (24) at the location of the deflection mechanism (384).

The exemplary deflection assembly (92) disclosed herein can be described as a double eccentric drive mechanism. Particularly, the outer ring (156) has a circular outer peripheral surface (160) and defines therein a circular inner peripheral surface (162). The outer ring (156), and preferably the circular outer peripheral surface (160) of the outer ring (156), is rotatably supported by or rotatably mounted on, directly or indirectly, the circular inner peripheral surface (78) of the housing (46). When indirectly supported, there can be included for example an intermediate housing (751) between the outer ring (156) and inner peripheral surface (78) of the housing (46). The portion of the housing (46) which houses the eccentric rings can be referred to as the deflector housing (46). In some embodiments, this housing (46) is cylindrically shaped to accommodate the shape of the outer ring. The circular outer peripheral surface (160) of the outer ring (156) may be supported or mounted on the circular inner peripheral surface (78) by any supporting structure, mechanism or device permitting the rotation of the outer ring (156) relative to the housing (46), such as by a roller bearing mechanism or assembly.

The circular inner peripheral surface (162) of the outer ring (156) is formed and positioned within the outer ring (156) such that it is eccentric with respect to the housing (46). In other words, the circular inner peripheral surface (162) is deviated from the housing (46) to provide a desired degree or amount of deviation.

Figure 3:
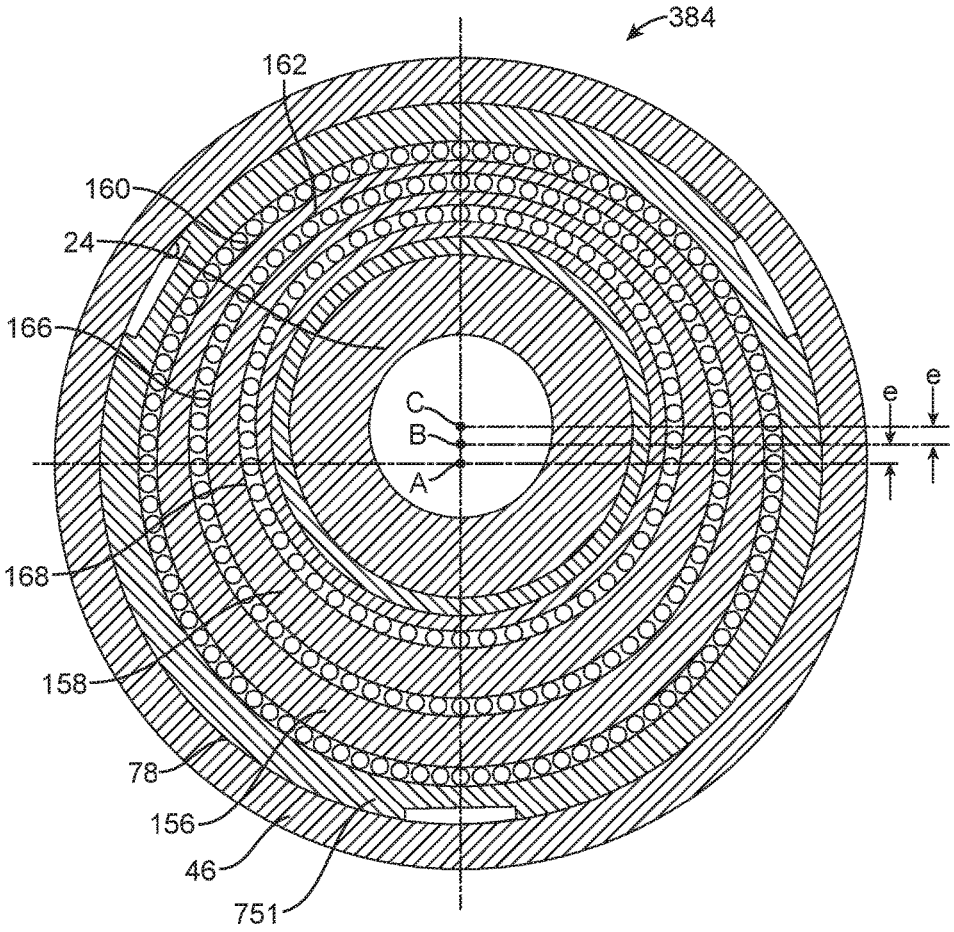
FIG. 3 is a schematic, transverse cross-section view of a drilling shaft deflection assembly, including a rotatable outer eccentric ring and a rotatable inner eccentric ring.

Still referring to FIG. 3, the circular inner peripheral surface (78) of the housing (46) is centered on the center of the drilling shaft (24), or the rotational axis "A" of the drilling shaft (24), when the drilling shaft (24) is in an undeflected condition or the deflection assembly (92) is inoperative. The longitudinal centerlines of the undeflected drilling shaft (24) and housing (46) are substantially coincident when the drilling shaft (24) is undeflected within the housing (46).

The circular inner peripheral surface (162) of the outer ring (156) is centered on point "B" which is offset from the centerlines of the drilling shaft (24) and housing (46) by a distance "e."

Similarly, the inner ring (158) has a circular outer peripheral surface (166) and defines therein a circular inner peripheral surface (168). The inner ring (158), and preferably the circular outer peripheral surface (166) of the inner ring (158), is rotatably supported by or rotatably mounted on, either directly or indirectly, the circular inner peripheral surface (162) of the outer ring (156). The circular outer peripheral surface (166) may be supported by or mounted on the circular inner peripheral surface (162) by any supporting structure, mechanism or device permitting the rotation of the inner ring (158) relative to the outer ring (156), such as by a roller bearing mechanism or assembly.

The circular inner peripheral surface (168) of the inner ring (158) is formed and positioned within the inner ring (158) such that it is eccentric with respect to the circular inner peripheral surface (162) of the outer ring (156). In other words, the circular inner peripheral surface (168) of the inner ring (158) is deviated from the circular inner peripheral surface (162) of the outer ring (156) to provide a desired degree or amount of deviation.

More particularly, the circular inner peripheral surface (168) of the inner ring (158) is centered on point "C", which is deviated from the center "B" of the circular inner peripheral surface (162) of the outer ring (156) by the same distance "e". As described, preferably, the degree of deviation of the circular inner peripheral surface (162) of the outer ring (156) from the housing (46), defined by distance "e", is substantially equal to the degree of deviation of the circular inner peripheral surface (168) of the inner ring (158) from the circular inner peripheral surface (162) of the outer ring (156), also defined by distance "e".

The drilling shaft (24) extends through the circular inner peripheral surface (168) of the inner ring (158) and is thereby rotatably supported. The drilling shaft (24) may be supported by the circular inner peripheral surface (168) by any supporting structure, mechanism or device permitting the rotation of the drilling shaft (24) relative to the inner ring (158), such as by a roller bearing mechanism or assembly.

As a result of the above described configuration, the drilling shaft (24) may be moved, and specifically may be laterally or radially deviated or pulled to the side within the housing (46), upon the movement of the center of the circular inner peripheral surface (168) of the inner ring (158). Specifically, upon the rotation of the inner and outer rings (158, 156), either independently or together, the center of the drilling shaft (24) may be moved with the center of the circular inner peripheral surface (168) of the inner ring (158) and positioned at any point within a circle having a radius equal to the sum of the amounts of deviation of the circular inner peripheral surface (168) of the inner ring (158) and the circular inner peripheral surface (162) of the outer ring (156).

In other words, by rotating the inner and outer rings (158, 156) relative to each other, the center of the circular inner peripheral surface (168) of the inner ring (158) can be moved to any position within a circle having the predetermined or predefined radius as described above. Thus, the portion or section of the drilling shaft (24) extending through and supported by the circular inner peripheral surface (168) of the inner ring (158) can be deflected by an amount in any direction perpendicular to the rotational axis of the drilling shaft (24).

More particularly, since the circular inner peripheral surface (162) of the outer ring (156) has the center B, which is deviated from the rotational center A of an undeflected drilling shaft (24) by the distance "e", the locus of the center B is represented by a circle having a radius "e" around the center A. Further, since the circular inner peripheral surface (168) of the inner ring (158) has the center C, which is deviated from the center B by a distance "e", the locus of the center "C" is represented by a circle having a radius "e" around the center B. As a result, the deviated center C of the drilling shaft (24) may be moved to any desired position within a circle having a radius of "2e" around the center A (see FIG. 3). Accordingly, the portion of the drilling shaft (24) supported by the circular inner peripheral surface (168) of the inner ring (158) can be deflected in any direction on a plane perpendicular to the undeflected rotational axis of the drilling shaft (24) by a distance of up to "2e" (i.e., "e" plus "e"), thus providing for variable positioning of the drilling shaft (24) within the circle having radius 2e. When deflected, the condition is also sometimes referred to as a "Deflection ON" setting.

In addition, as stated, the two deviation distances "e" are preferably substantially similar in order to permit the operation of the rotary steerable drilling device (20) such that the drilling shaft (24) is undeflected within the housing (24) when directional drilling is not required. More particularly, since the degree of deviation of each of the centers B and C of the circular inner peripheral surface (162) of the outer ring (156) and the circular inner peripheral surface (168) of the inner ring (158), respectively, is preferably defined by the same or equal distance "e", the center C of the portion of the drilling shaft (24) extending through the deflection assembly (92) can be positioned on the undeflected rotational axis A of the drilling shaft (24) (i.e., "e" minus "e"), in which case the rotary steerable drilling device (20) is in a zero deflection mode which is sometimes referred to as a "Deflection OFF" setting.

Figure 4:
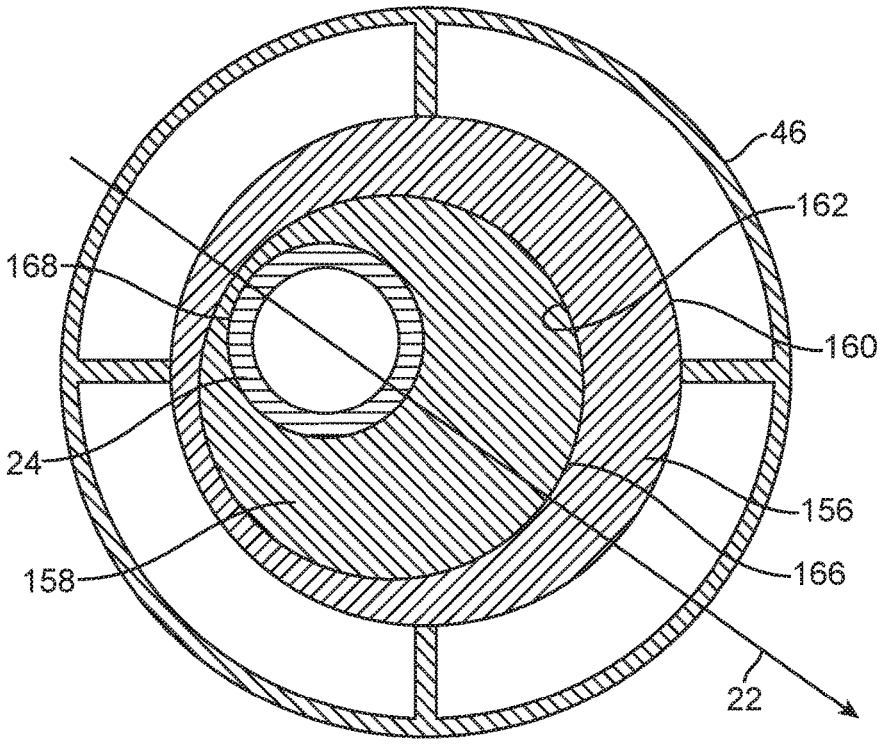
FIG. 4 is a simplified schematic of a transverse cross-section view of the deflection assembly of the drilling shaft deflection assembly that exaggerates the offset position of the drilling shaft relative the housing.

A simplified and exaggerated expression of the drilling shaft (24) deflection concept is illustrated in FIG. 4. As depicted, the orientation of the rings (156, 158) causes deflection of the drilling shaft (24) in one direction thereby tilting the drilling bit (22) in the opposite direction relative to the centerline of the deflector housing (46).

This simplified depiction of FIG. 4 more clearly illustrates how actuation of the deflection assembly pulls the drilling shaft (24) to the side within the deflector housing (46) and in this manner deflects or bends the drilling shaft (24) because the shaft (24) is otherwise radially centered and anchored in the housing (46) at both ends of the shaft (24) by the radial distal bearing (82, 84). From this exaggerated perspective in FIG. 4, it is also easier to appreciate the fact that revolution of the deflected shaft around in the housing (46), for instance by rotating the outer ring (156) with the inner ring (158) held fast, causes the bowed (deflected) drilling shaft (24) to orbit about within the housing, resembling a rotating jump-rope. In this way the direction that the lower end of the shaft (24) extends out of the housing (46) is established. This directional extension at the deflected angle establishes a desired toolface orientation of the bit. For example, once the eccentric rings (156, 158) are rotated to create the desired deflection, the rings (156, 158) can be fixed relative to one another and rotated together in order to orient the drill bit (22) in the desired angular direction relative to the housing's (46) centerline.

Powering the Deflection Assembly

Figure 5:
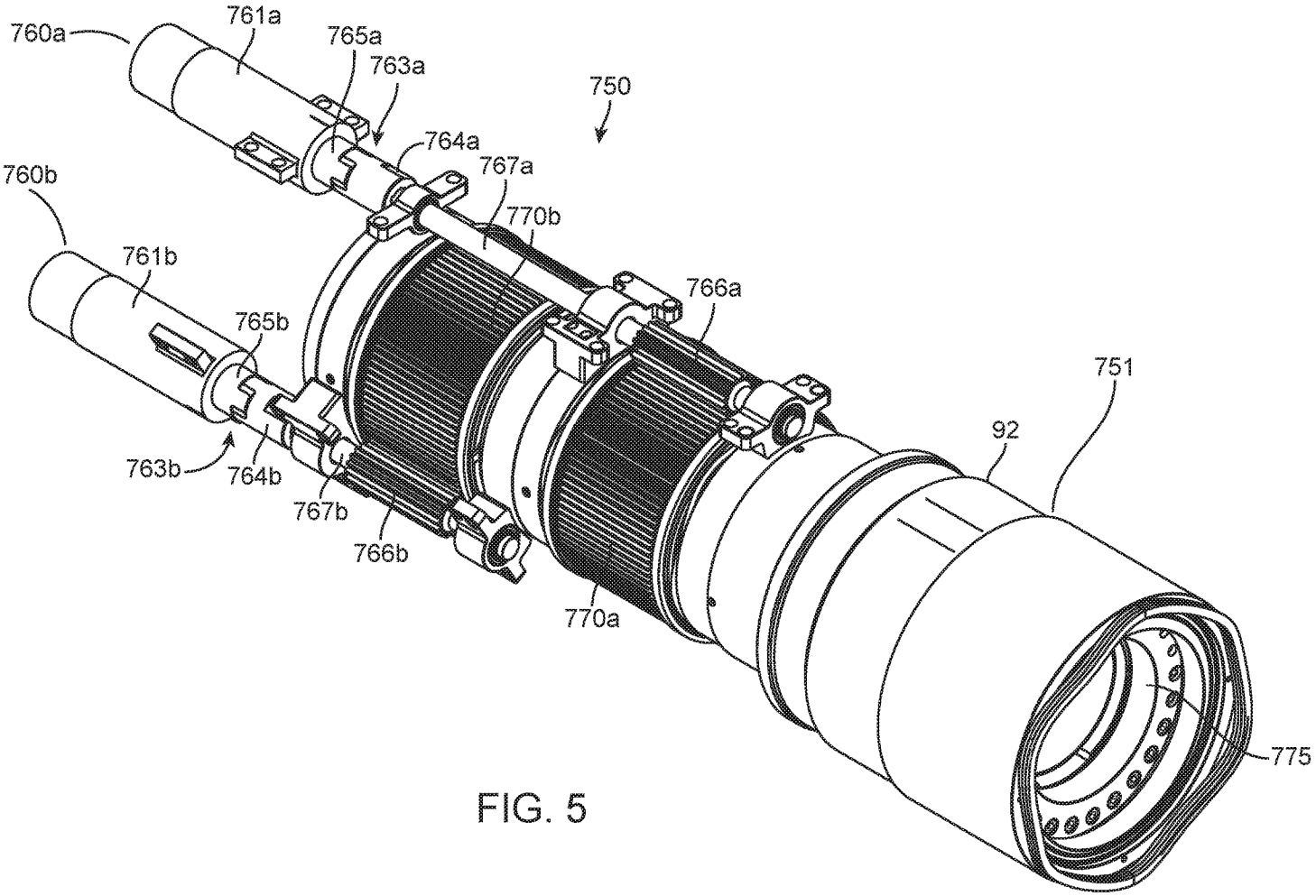
FIG. 5 is a perspective view of one embodiment of an internal portion of a drilling shaft deflection device having a pair of drive motors.
Figure 6:
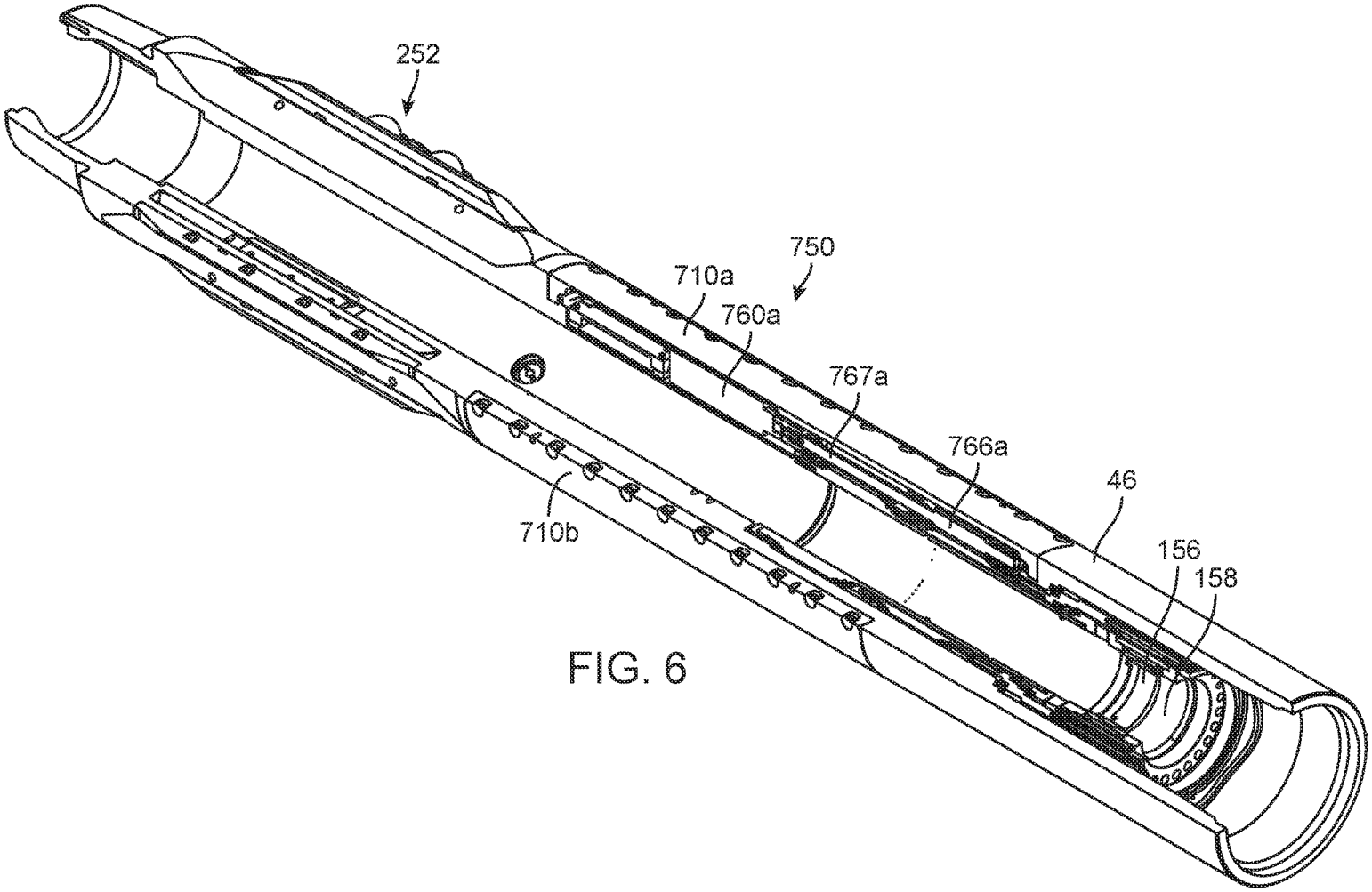
FIG. 6 is a partial cut-away perspective view of a portion of a rotary steerable drilling device comprising the drilling shaft deflection device.

A simplified biasing mechanism is disclosed that employs at least one motor for rotating the eccentric rings of the drilling shaft deflection assembly (92). Referring to FIG. 5, a drilling shaft deflection device (750) is shown with the housing removed, exposing the internal portion of the deflection device (750). Referring to FIG. 6, covered hatches (710*a*) and (710*b*) are shown which permit access to at least a portion of the deflection device (750) in an exteriorly exposable recess of the housing (46). The hatches (710*a*, 710*b*) can be secured to the housing (46) with threaded bolts or similar releasable securement mechanisms that facilitate the hatches' (710*a*, 710*b*) removal. A seal can also be provided between the hatches (710*a*, 710*b*) and the housing (46) which maintains a fluid tight, closed compartment within the housing (46).

Received beneath the hatches (710*a*, 710*b*) are two brushless DC (BLDC) drive motors; an outer eccentric ring drive motor (760*a*) and an inner eccentric ring drive motor (760*b*). Any type of motor may be used capable of providing rotational bias or power to the eccentric rings, including but not limited to hydraulic motors and electric motors. Suitable electric motors include AC motors, brushed DC motors, piezo-electric motors, and electronically commutated motors (ECM). The term ECM can include all variants of the general class of electronically commutated motors, which may be described using various terminology such as a BLDC motor, a permanent magnet synchronous motor (PMSM), an electrically commutated motor (ECM/EC), an interior permanent magnet (IPM) motor, a stepper motor, an AC induction motor, and other similar electric motors which are powered by the application of a varying power signal, including motors controlled by a motor controller that induces movement between the rotor and the stator of the motor.

In some examples an ECM is employed, and in particular, in the illustrated embodiment of FIG. 5, a BLDC motor is used. ECMs, as disclosed herein, do not require brushes or contacts between the rotor and the stator. An advantage of ECMs is that they can be relatively simple in construction; however the motor controller component of an ECM may be relatively complex. Additionally, an ECM is well suited for applications which require maintenance-free operation or high rotation speeds. An ECM also provides certain capabilities not available with a brushed motor, including precise speed limiting, positioning and control such as establishing micro-stepped operations for slow and/or fine motion control. Such features foster reliability and facilitate serviceability by reducing the number of parts and components and decreasing service time. Additionally, due to the relatively small size of ECMs and the flexibility in arranging the motors and the associated components on the rotary steerable drill (20), the overall length of the drilling shaft deflection device can be minimized, and thus take up less space.

In some examples the ECM can have built-in features which are inherent or included in the device. For example, the ECM can optionally have a braking mechanism, such as a detent brake, to prevent movement of the output shaft of the motor when the ECM is not being purposefully rotated. An additional built-in feature can include a feedback mechanism such as an included resolver or associated Hall effect sensors that track the position of the rotor relative to the stator in order to facilitate operation of the ECM by the motor controller.

Referring again to FIG. 5, the eccentric ring drive motors (760*a*, 760*b*) can be substantially cylindrical and small relative the size and diameter of the housing (46) (see FIG. 6). The eccentric ring drive motors (760*a*, 760*b*) can be housed in a motor housing (761*a*, 761*b*) which provides a surface which substantially contains the contents of the drive motor components. The drive motor housing (761*a*, 761*b*), is radially offset, aside the longitudinal centerline of the housing (46). Further, the motor housing (761*a*, 761*b*) of drive motors (760*a*, 760*b*) can be anchored to the housing (46) located proximate thereto. The motor housing (761*a*, 761*b*) of the drive motors (760*a*, 760*b*) can be circumferentially spaced apart one from another about the housing (46). In such case, the motor housing (761*a*, 761*b*) of the drive motors (760*a*, 760*b*) can be circumferentially spaced apart, one from another, by any degree, including about 45 degrees, or about 60 degrees, or about 70 degrees, or about 90 degrees, or about 120 degrees, or about 180 degrees, and in some examples less than about 90 degrees, or less than about 180 degrees around the housing (46). In some examples, the drive motors (760*a*, 760*b*) are spaced so that they are easily accessible when hatches (710*a*, 710*b*), shown in FIG. 6, are removed.

The drive motors (760*a*, 760*b*) are each coupled to a pinion (766*a*, 766*b*) via upper spider coupling (763*a*) and lower spider coupling (763*b*). The spider couplings (763*a*, 763*b*) are each comprised of opposing interlocking teeth (762*a*, 762*b*) which communicate rotation from the drive motors (760*a*, 760*b*) to a set of pinions (766*a*, 766*b*). The upper coupling portion (765*a*, 765*b*) of each spider coupling (763*a*, 763*b*) includes a series of teeth and channels that engage a similar (mirror image) series of teeth and channels on the lower coupling portion (764*a*, 764*b*) of each spider coupling (763*a*, 763*b*). There can be drive shafts (767*a*, 767*b*) which extend from the lower coupling portion (764*a*, 764*b*) to an outer eccentric ring pinion (766*a*) and inner eccentric ring pinion (766*b*). The respective pinions (766*a*, 766*b*) are each splined, having gear teeth that engage with an outer eccentric ring spur gear (770*a*) and inner eccentric ring spur gear (770*b*). The spur gears (770*a*, 770*b*) are each splined, having gear teeth that surround the entire peripheral edge of the respective gear and receive the teeth from pinions (766*a*, 766*b*). The spur gears (770*a*, 770*b*) can have substantially the same diameter, with a circumference less than that of the housing (46), and in some embodiments the same or greater than the outer eccentric ring (156).

The pinions (766*a*, 766*b*) are positioned adjacent the spur gears (770*a*, 770*b*), at their periphery, so that pinion teeth intermesh with spur gear teeth as shown in FIG. 5. The motors (760*a*, 760*b*) provide rotational driving force that is communicated through the spider coupling (763*a*, 763*b*) and drive shafts (767*a*, 767*b*) causing rotation of the pinions (766*a*, 766*b*). The rotating pinions (766*a*, 766*b*) engage and rotate the spur gears (770*a*, 770*b*). The spur gears (770*a*, 770*b*) can be connected directly or indirectly to the outer and inner eccentric rings (156, 158) contained within the body of the deflection device (750). For example, spur gears (770*a*, 770*b*) can be bolted to inner and outer eccentric rings (156, 158). In the illustrated example, the outer eccentric ring spur gear (770*a*) is coupled to the outer eccentric ring (156) via a linkage, which may take the form or an interconnected cylindrical sleeve. The inner eccentric spur gear (770*b*), however, is coupled to the inner eccentric ring (158) via an Oldham coupling. The Oldham coupling permits off-center rotation and the necessary orbital motion of the inner eccentric ring (158) relative the housing (46).

The inner eccentric ring spur gear (770*b*) permits deflection or floating of the drilling shaft (24) held in the interior aperture of the inner eccentric ring (156). As the drilling shaft (24) orbits about within the housing (46) as the orientations of the eccentric rings change, the powering transmission, at least to the inner eccentric ring (156), must shift in order to maintain connection to the ring (156), and this is accomplished by use of the Oldham coupling.

In the illustrated embodiment of FIG. 5, the drive motors (760*a*, 760*b*) are positioned at the top or proximal end (left side of the FIG. 5) of the drilling shaft deflection device (750). As shown, the outer eccentric ring pinion (766*a*) is positioned further down, toward the distal end of the drilling shaft deflection device (750). In other embodiments, the drive motors (760*a*, 760*b*) can be lengthwise offset, one from the other, relative the housing (46).

The outer eccentric ring spur gear (770*a*) and inner eccentric ring spur gear (770*b*) are positioned adjacent one another, but with the outer eccentric ring spur gear (770*a*) positioned further along the body in the distal direction. The inner eccentric ring spur gear (770*b*) is positioned adjacent the outer eccentric ring spur gear (770*a*) in the proximal direction away from the drill bit (22) and further from the eccentric rings (156, 158) as shown in FIG. 6.

FIG. 6 is a perspective or diagrammatic overhead view that illustrates a portion of the rotary steerable drilling device (20) with a top section removed to view internal details of the drilling shaft deflection device (750). A substantial portion of the drilling shaft deflection device (750) is nested within walls of the housing (46) beneath removable hatches (710*a*, 710*b*). In this view, the motor (760*a*) is positioned beneath the hatch (710*a*), as are the related pinion (766*a*) and spur gear. Such an arrangement enables easy operator access to the motors, as well as other components for repair and/or maintenance. The eccentric rings (156, 158) can be positioned along the drilling shaft deflection device (750) beyond the hatches (710*a*, 710*b*) at the far end, in the distal direction.

Figure 7:
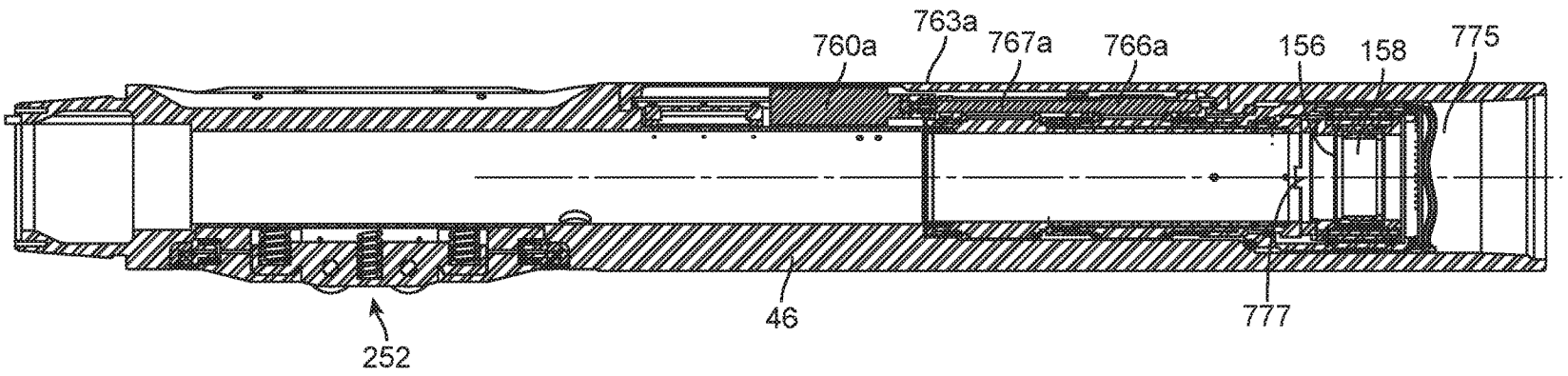
FIG. 7 is a section view of the embodiment of FIG. 6 showing a portion of a rotary steerable drilling device comprising the pair of drive motors.

FIG. 7 is a sectional view of the exemplary drilling shaft deflection device shown in FIG. 6. Therein, an outer eccentric ring drive motor (760*a*), outer eccentric ring spider coupling (763*a*), drive shaft (767*a*), and outer pinion (766*a*) are depicted, as are the outer eccentric ring (156) and the inner eccentric ring (158). Additionally, the Oldham coupling (777) that couples the inner eccentric ring spur gear (770*b*) to the inner eccentric ring is depicted. Adjacent the eccentric rings (156, 158) is distal shaft exit (775) where the drilling shaft passes through to the drill bit.

Figure 8:
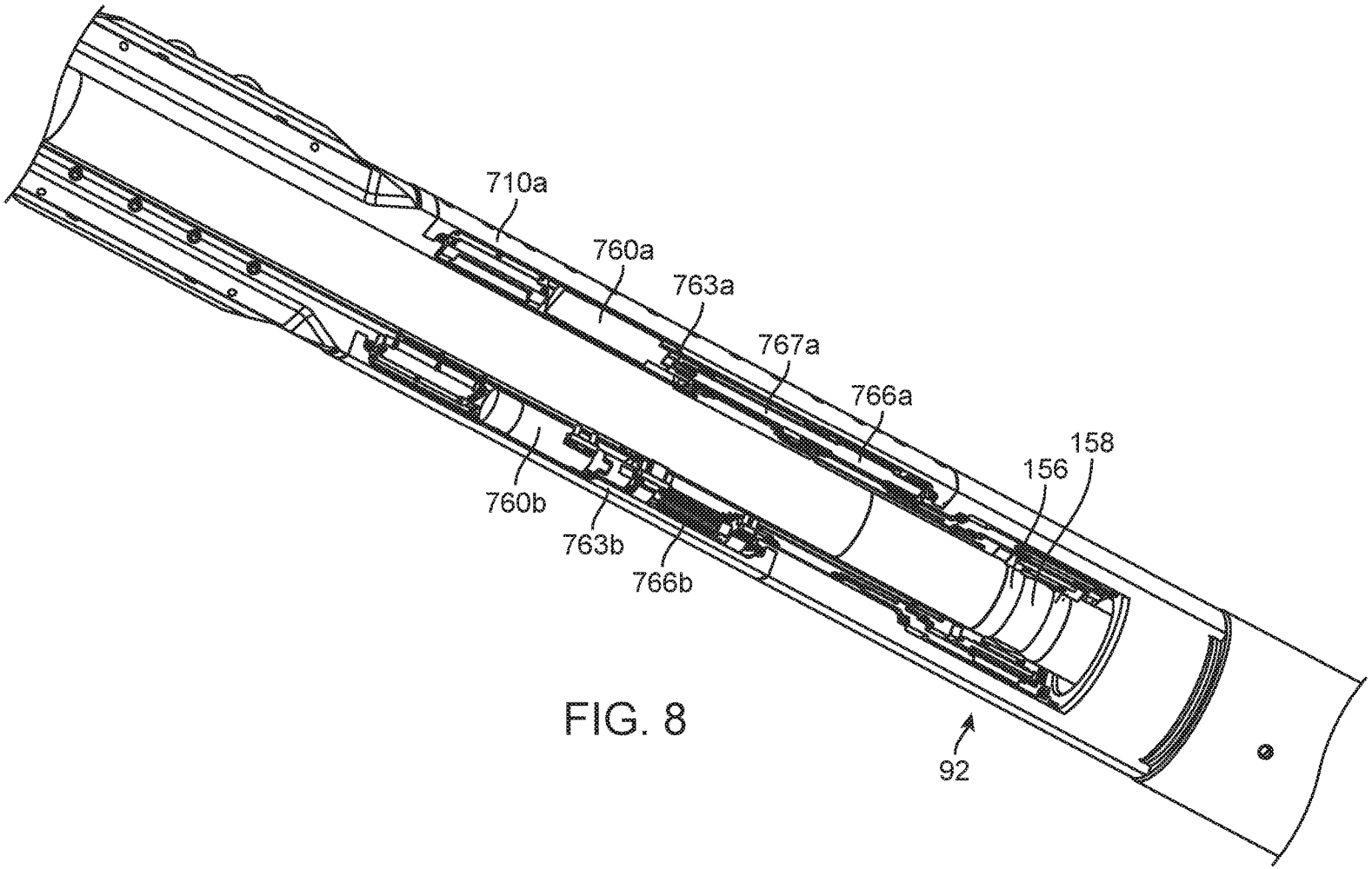
FIG. 8 is a partial cut-away perspective view of a portion of a rotary steerable drilling device comprising the drilling shaft deflection device showing details of the pair of drive motors, transmissions and eccentric inner and outer rings.

Referring now to FIG. 8, this partial cutaway view shows certain details of the drilling shaft deflection device, including both motors (760*a*, 760*b*), the associated transmissions, pinions (766*a*, 766*b*), spur gears and eccentric rings (156, 158).

Figure 9:
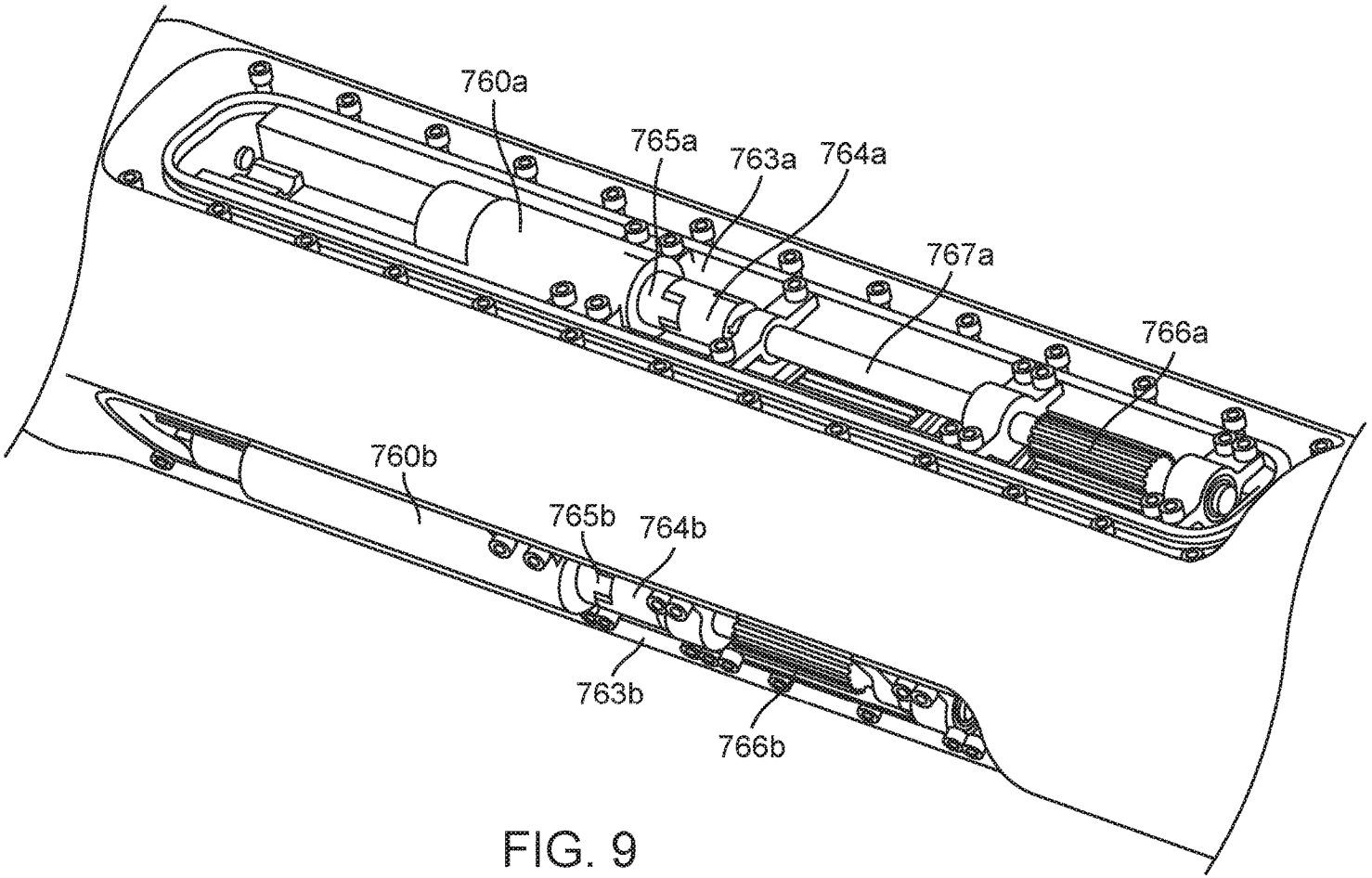
FIG. 9 is a perspective overhead view of a portion of a rotary steerable drilling device with hatch covers removed and the pair of drive motors and transmissions exposed.

FIG. 9 illustrates a perspective view of the drilling shaft deflection device where the motors (760*a*, 760*b*), shafts (767*a*) and pinions (766*a*, 766*b*) are located. As illustrated, the hatch covers (710*a*, 710*b*) shown in FIG. 6 have been removed. Further, one hatch is longer than the other and extends a further distance toward the distal end of the drilling shaft deflection device. This is dictated by the position of the outer eccentric ring pinion (766*a*) being further down, closer to the eccentric rings, than the inner eccentric ring pinion (766*b*). However, as discussed above, in other embodiments, the inner eccentric ring pinion (766*b*) and inner eccentric ring spur gear (770*b*) can be positioned closer to the eccentric rings than the outer eccentric ring pinion (766*a*) and outer eccentric ring spur gear (770*a*).

Referring now to FIGS. 1-9 collectively, in operation, the drilling shaft deflection device (750) provides advantageous control in obtaining desired deflection (bend) as well as desired azimuthal orientation of the drilling shaft (24). With respect to deflection, the motors can rotate the eccentric rings to bend the drilling shaft (24) to any desired deflection ranging from no deflection up to the maximum amount mechanically permitted. As discussed previously, in a "Deflection OFF" setting, the center C of inner eccentric ring (158) is positioned on the rotational axis A of outer ring (156) thereby providing no deflection (i.e., "e" minus "e"). In a "Deflection ON" setting, the eccentric rings (156, 158) are oriented so that the axial centers add to each other giving a non-zero result (i.e., "e" plus "e" is not equal to zero).

In order to deflect drilling shaft (24), outer eccentric ring drive motor (760*a*) can hold outer eccentric ring (156) from rotating while at the same time inner eccentric ring drive motor (760*b*) can apply rotating force to rotate inner eccentric ring (158) in either direction (clockwise or counterclockwise; i.e., bi-directional). Alternatively, inner eccentric ring drive motor (760*b*) can hold inner eccentric ring (158) from rotating while at the same time outer eccentric ring drive motor (760*a*) can apply rotating force to rotate outer eccentric ring (156) in either direction. Additionally, both motors (760*a*, 760*b*) can be simultaneously operated which correspondingly rotates eccentric rings (156, 158) to achieve a desired deflection.

In practice, a control signal is sent to one or both motors (760*a*, 760*b*) which then actuates and applies a rotating force through one or both spider couplings (763*a*, 763*b*) to drive the shafts (765*a*, 765*b*) that rotate their respective pinions (766*a*, 766*b*). The pinions (766*a*, 766*b*) engage and rotate their respective spur gears (770*a*, 770*b*), which communicate rotation to the respective eccentric rings (156, 158). In this way, the eccentric rings can be singly, or simultaneously rotated from a position in which the axial centers are aligned (i.e., "e" minus "e" equals zero) to any other desired position within a circle having a radius of "2e" around the centerline A of the housing (46). In this way the drilling shaft (24) is deflected at a desired angle. That is, the amount of deflection is affected based on how far the drilling shaft (24) is radially displaced (pulled) away from the centerline of the housing (46). The degree of radial displacement can be affected by rotation of one or both of the eccentric rings (156, 158), in either direction.

In practice, the drilling shaft (24) is effectively supported at three locations in the housing (46): at each of the two ends of the housing (46) by radial or fulcrum bearings and at the middle of the housing (46) by the eccentric rings (156, 158). The fulcrum bearings keep the drilling shaft (24) centered on the centerline of the housing (46) at their locations, but permit the shaft to pivot at the bearing, resulting in the shaft (24) projecting from the bottom end of the housing (46) at a particular angle when the middle of the shaft is radially pulled to the side, out of alignment with the centerline of the housing (46). The degree to which the drilling shaft (24) is pulled out of alignment from the centerline of the housing (46) dictates the severity of the angle, relative to the centerline of the housing (46), by which the drilling shaft (24) projects out of the bottom end of the housing (46).

Once the desired deflection is obtained, indexing can be carried out to set the direction of the drilling shaft (24). Most simply, both the outer and inner eccentric rings (156, 158) can be rotated together, as a unit, in order to "point" the projecting drilling shaft (24) in a particular direction, while maintaining the angle of deflection. This can be accomplished by fixing the inner eccentric ring (158) relative to the outer eccentric ring (156), and then rotating the outer eccentric ring (156). This causes the now-deflected drilling shaft (24) at the inner eccentric ring (158) to "orbit" on a circle having a radius equal to the distance of deflection of the drilling shaft (24) off of the centerline of the housing (46). In practice, indexing is performed to set a desired azimuthal direction of the drill bit (22) at the bottom end of the drilling shaft (24) which also sets the orientation of the toolface of the bit (22).

In another aspect, though anchored to the wellbore, the rotary steerable drilling device (2) will still experience some slippage relative to the ground, causing the housing (46) to "roll" within the wellbore from its original and known orientation. Accordingly, to counteract such housing roll and maintain the intended azimuthal drilling direction, one or both of the eccentric rings can be rotated together to maintain a desired amount of deflection and the desired azimuthal drilling direction. With dual ECM motors, the deflection and azimuthal direction can be obtained simultaneously by independent rotation of the outer eccentric ring (156) and inner eccentric ring (158).

Therefore in some exemplary embodiments, the two motors can be controlled independently and differently from one another. For instance, the motors may be operated at different speeds, in different directions and for different periods of time to achieve a desired degree of deflection and azimuthal drilling direction. As an example, the inner eccentric ring (158) can be rotated at the same speed, faster or slower, in the same direction or the opposite direction as outer eccentric ring (156). The same applies for outer eccentric ring (156) with respect to inner eccentric ring (158). Ultimately, the most expedient combination of motion of the two rings (156, 158) is employed to affect the desired degree of deflection and azimuthal drilling direction.

These advantageous operational capabilities are facilitated by the use of the dual ECM motors that deliver bi-directional actuation not present in indirect systems such as clutch systems. Further, if one motor breaks down, zero deflection of the rotary steerable drilling device (20) can still be affected by actuating the working motor to rotate its related eccentric ring to a zero deflection position relative the position of the non-functioning ring. By always being able to bring the drilling shaft (24) to an undeflected orientation, the rotary steerable drilling device (20) can be streamlined to avoid being stuck, downhole.

As explained above, during drilling, the rotary steerable drilling device (20) is anchored against rotation in the wellbore which would otherwise be imparted by the rotating drilling shaft (24). To affect such anchoring, one or more anti-rotation devices (252) (FIGS. 2*a*, 2*b*, 6 and 7) are associated with the rotary steerable drilling device (20) for resisting rotation within the wellbore. Any type of anti-rotation device (252) or any mechanism, structure, device or method capable of restraining or inhibiting the tendency of the housing (46) to rotate upon rotary drilling may be used. Advantageously, wheels resembling round pizza cutters can be employed that extend at least partially outside the rotary steerable drilling device (20) and project into the earth surrounding the borehole. The wheels are aligned for rotation down the well, allowing the rotary steerable drilling device (20) to progress downhole during drilling. The wheels, however, present a side-face to the earth that resists rotation of the rotary steerable drilling device (20).

The embodiments shown and described above are only examples. Many details are often found in the art such as the other features of a logging system. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A drilling shaft deflection device for controlling a deflection angle and azimuthal toolface direction of a drill bit in a rotary steerable subterranean drill, the drilling shaft deflection device comprising:

a drilling shaft rotatably supported in a housing;

a drilling shaft deflection assembly comprising an outer eccentric ring and an inner eccentric ring that engages the drilling shaft; and a pair of drive motors fixed relative the housing such that there is no relative movement between the housing and the pair of drive motors, the pair of drive motors respectively coupled, one each, to the inner and outer eccentric rings for independently rotating each eccentric ring in either rotational direction.

2. The drilling shaft deflection device of claim 1, further comprising:

the housing being generally cylindrical and having a longitudinal centerline, the longitudinal centerlines of the drilling shaft and housing being substantially coincident when the drilling shaft is undeflected within the housing;

the drilling shaft deflection assembly contained within the housing;

the outer eccentric ring being rotatably supported at an inner peripheral surface of the housing and having a circular inner peripheral surface that is eccentric with respect to the housing;

the inner eccentric ring being rotatably supported at the circular inner peripheral surface of the outer eccentric ring and having a circular inner peripheral surface that engages the drilling shaft and which is eccentric with respect to the circular inner peripheral surface of the outer eccentric ring; and one of the pair of motors drivingly coupled by a first transmission to the outer eccentric ring and which rotates the outer eccentric ring in a first direction and an opposite, second direction relative to the housing and the other of the pair of motors drivingly coupled by a second transmission to the inner eccentric ring and which rotates the inner eccentric ring relative to the outer eccentric ring.

3. The drilling shaft deflection device of claim 2, wherein at least one drive motor comprises a motor housing and the motor housing is radially offset, aside the longitudinal centerline of the housing.

4. The drilling shaft deflection device of claim 3, wherein the motor housing is anchored to the housing and located proximate thereto.

5. The drilling shaft deflection device of claim 2, wherein each of the pair of drive motors comprises a motor housing and each of the motor housings is radially offset, aside the longitudinal centerline of the housing.

6. The drilling shaft deflection device of claim 5, wherein each of the motor housings is anchored to the housing and located proximate thereto.

7. The drilling shaft deflection device of claim 6, wherein the motor housings are circumferentially spaced apart, one from the other about the housing.

8. The drilling shaft deflection device of claim 7, wherein the motor housings are circumferentially spaced apart, one from the other, at less than 90 degrees.

9. The drilling shaft deflection device of claim 7, wherein the motor housings are circumferentially spaced apart, one from the other, at less than 180 degrees.

10. The drilling shaft deflection device of claim 2, wherein at least one of the drive motors is housed within an exteriorly exposable recess into the housing.

11. The drilling shaft deflection device of claim 10, further comprising a releasably attached cover over an exterior opening into the recess and thereby establishing a closed compartment for the drive motor.

12. The drilling shaft deflection device of claim 11, wherein the attached cover is sealed, fluid tight, over the exterior opening into the recess and thereby establishes a compartment in which the at least one drive motor is enclosed.

13. The drilling shaft deflection device of claim 2, wherein each of the pair of drive motors is a hydraulic motor.

14. The drilling shaft deflection device of claim 2, wherein each of the pair of drive motors is an electronically commutated motor.

15. The drilling shaft deflection device of claim 14, wherein each of the electronically commutated motors is a brushless direct current motor.

16. The drilling shaft deflection device of claim 2, wherein the first transmission coupling one of the pair of motors to the outer eccentric ring comprises a driveshaft coupled to and driven by the motor and a pinion gear engaged with a spur gear coupled to and driving the outer eccentric ring.

17. The drilling shaft deflection device of claim 2, wherein the second transmission coupling one of the pair of motors to the inner eccentric ring comprises a driveshaft coupled to and driven by the motor and a pinion gear engaged with a spur gear coupled to and driving the inner eccentric ring.

18. The drilling shaft deflection device of claim 2, wherein the first transmission coupling a first of the pair of motors to the outer eccentric ring comprises a first driveshaft coupled to and driven by the first motor and a first pinion gear engaged with a first spur gear coupled to and driving the outer eccentric ring, and the second transmission coupling a second of the pair of motors to the inner eccentric ring comprises a second driveshaft coupled to and driven by the second motor and a second pinion gear engaged with a second spur gear coupled to and driving the inner eccentric ring.

19. The drilling shaft deflection device of claim 18, wherein the first driveshaft is shorter than the second driveshaft.

20. The drilling shaft deflection device of claim 19, wherein each of the pair of drive motors comprises a motor housing and wherein the motor housings are longitudinally abreast of one another and circumferentially spaced apart, one from the other relative to the housing.

21. The drilling shaft deflection device of claim 1, wherein the pair of motors are anchored to the housing.

* * * * *